US006197236B1

(12) United States Patent
Oldemeyer et al.

(10) Patent No.: US 6,197,236 B1
(45) Date of Patent: Mar. 6, 2001

(54) METHOD OF MANUFACTURING FIBREBOARD FROM WOOD CHIPS USING ISOCYANATE AS BINDER

(75) Inventors: Wilhelm Oldemeyer, Meppen; Werner Sanders, Haren; Gert Teuber, Meppen, all of (DE)

(73) Assignee: Bayer Aktiengesellschaft, Leverkusen (DE)

( * ) Notice: Subject to any disclaimer, the term of this patent is extended or adjusted under 35 U.S.C. 154(b) by 0 days.

(21) Appl. No.: 08/175,376

(22) PCT Filed: Jun. 30, 1992

(86) PCT No.: PCT/EP92/01467

§ 371 Date: Mar. 7, 1994

§ 102(e) Date: Mar. 7, 1994

(87) PCT Pub. No.: WO93/01033

PCT Pub. Date: Jan. 21, 1993

(30) Foreign Application Priority Data

Jul. 10, 1991 (DE) ..... 41 22 842

(51) Int. Cl.[7] ..... B27N 1/02
(52) U.S. Cl. ..... 264/115; 264/121
(58) Field of Search ..... 264/109, 115, 264/121

(56) References Cited

U.S. PATENT DOCUMENTS

| | | | | |
|---|---|---|---|---|
| 3,371,137 | * | 2/1968 | Asplund | 264/121 |
| 4,209,433 | * | 6/1980 | Hse | 264/109 X |
| 4,407,771 | * | 10/1983 | Betzner et al. | 264/115 |
| 5,034,175 | * | 7/1991 | Safstrom | 264/120 |
| 5,093,058 | * | 3/1992 | Harmon et al. | 264/115 |

FOREIGN PATENT DOCUMENTS

| | | |
|---|---|---|
| 378729 | 9/1985 | (AT) . |
| 2023659 | 11/1971 | (DE) . |
| 1021629 | 6/1983 | (SU) . |

OTHER PUBLICATIONS

Abstract—Soviet Invention Illustrated Wk. 8413, May 9, 1984, Derwent Publications Ltd., London, GB AN 080276 & SU, A, 1021629 (Woodwork Ind Resin) Jun. 7, 1983.

* cited by examiner

*Primary Examiner*—Jan H. Silbaugh
*Assistant Examiner*—Kenneth M. Jones
(74) *Attorney, Agent, or Firm*—Joseph C. Gil; N. Denise Brown

(57) ABSTRACT

The invention relates to a process for the production of fiberboards from coarse wood particles and isocyanate as binder, in which the wood particles are heated under excess water vapor pressure and simultaneously comminuted to fibers which are then delivered with expansion to a drier by means of a blowing pipe, and dried in the drier.

5 Claims, 2 Drawing Sheets

METHOD OF MANUFACTURING FIBREBOARD FROM WOOD CHIPS USING ISOCYANATE AS BINDER

BACKGROUND OF THE INVENTION

Figure 1:
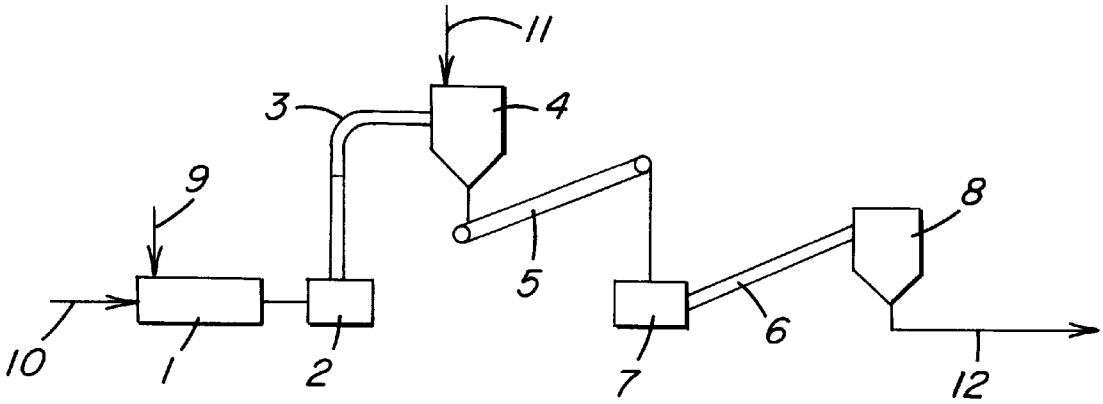

The invention relates to a process for the production of fibreboards from coarse wood particles and isocyanate as binder, in which the wood particles are heated under excess water vapour pressure and simultaneously comminuted to fibres which are then delivered with expansion to a drier by means of a blowing pipe, and dried in the drier. Downstream of the drier the fibres are then formed into mats in the customary manner and treated further to form the finished fibreboards. The fibreboards according to the present invention are medium density fibreboards in which wood chips or inexpensive types of wood can be used as wood particles so as to make better use of the raw material wood. As far as their mechanical and physical properties are concerned fibreboards can be compared to wood chipboards, although they display uniform density and fineness of structure throughout their thickness. In addition they have a smooth, coherent surface which allows them to be readily, processed and subjected to a large number of finishing techniques.

EP Patent No. 0 092 699 discloses a process of the kind mentioned in the introduction. The wood particles are digested in a digester under excess water vapour pressure and delivered to a refiner in which the wood particles are comminuted to hot, wet fibres. The hot, wet fibres are delivered from the refiner to a separator via a blowing device comprising a blowing pipe. The digester, the refiner and the blowing pipe are operated under pressure, of for example 8 bars. The temperatures of the hot fibres are in the order of 150 to 160° C. At the end of the blowing pipe leading to the separator reduction in pressure, i.e. expansion, takes place since the separator is operated at normal pressure. In the known process the isocyanate is added as binder In the region of the blowing pipe, i.e. in a region in which excess pressure prevails. The isocyanate is applied to the hot, wet fibres prior to expansion. In the blowing pipe the fibres are preferably vortexed and the isocyanate is homogeneously distributed on the hot, wet fibres, so that lump formation is avoided. Size specks in the finished fibreboard are also thereby advantageously avoided. The addition of the isocyanate binder to the hot, wet fibres in the blowing pipe does however cause pre-curing of the isocyanate, which means that encrustations may form on the inner periphery of the blowing pipe, which thus gradually becomes blocked. Continuous operation is thus considerably disrupted and stoppages are necessary to allow the blowing pipe to be cleaned.

From "Tendenzen der MDP-Plattenerzeugung" (Trends in the manufacture of median density fibreboards) on pages 379 to 382 of the journal 'Holz als Roh- und Werkstoff' (Wood as a raw and processing material) 36 (1978) it is known to add the binder at the exit to the drier. The fibres are thus also hot as a result of the drying process when the binder is added. It is applied to the thin, hot fibres with the aid of sizing blenders commonly employed in the chipboard industry. Although the binder is applied to the hot fibres under normal pressure, problems with pre-curing also occur in this process which are counteracted by the use of large volume intermediate bunkers. One of the main problems encountered in this conventional process of sizing fibres with precondensed urea resins is the formation of size specks, since it is apparently not possible, despite the intense fixing process, to apply the binder to the fibres uniformly and in the required finely distributed form. Also, intense mixing and even the use of large volume intermediate bunkers requires extensive periods of time, which are not conducive to the prevention of pre-curing of the binder.

The invention is based on the problem of providing a process for the production of fibreboards sized with isocyanate, of the kind mentioned in the introduction, in which there is neither the danger of size speck formation nor of any significant pre-curing of the isocyanate.

DESCRIPTION OF THE INVENTION

According to the invention this is achieved by spraying the isocyanate on to the fibres after they leave the blowing pipe and before they are dried. Surprisingly lump formation in the fibre material is thereby avoided as well as the formation of size specks on the finished fibreboard, despite the fact that the isocyanate is added at an even earlier stage of the production process than at the known point of addition after the drying step. Thus the expansion which occurs at the exit of the blowing pipe and the corresponding reduction in pressure and temperature of the fibres is utilised in a skilful manner, with the result that the isocyanate is no longer applied to the hot and wet fibres in the blowing pipe but to the comparatively colder and drier fibres. The temperature of the fibres is reduced as a result of the evaporation of water during expansion. When the isocyanate is applied to the fibres they are in a state of intense motion and considerable velocity and the isocyanate can thus be applied in a finely distributed form, lump formation thus being counteracted from the outset. Also, the subsequent movement of the fibres sized with the binder in the intermediate transporting apparatus, and in particular in the drier, is utilised for the purpose of completing the uniform, fine distribution of the binder on the fibres. Pre-curing of the isocyanate is advantageously avoided, not only because the isocyanate is applied to comparatively colder and drier fibres, but also—as experiments have shown—because the increase in temperature in the drier and the very short residence time of the fibres therein does not produce any significant pre-curing. It is an important factor that large volume intermediate bunkers and comparatively long residence times in forced circulation mixers arranged downstream of the drier are avoided, with the result that after the sized fibres have been dried, they can be immediately processed further into fibreboards. It is therefore possible not only to produce fibreboards free of size specks but also to reduce the throughput time and above all to reduce the main contact time between the isocyanate and the fibres compared to the two processes known from the prior art.

The isocyanate is sprayed on to the fibres preferably when they are at normal pressure, i.e. after expansion has taken place. At this point in time the reduction in the temperature of the fibres resulting from the evaporation of water has come into full effect and the isocyanate sprayed onto the fibres is thus not heated to temperature ranges of the kind to which it would be subjected if applied in the blowing pipe.

The isocyanate can be sprayed on to the fibres immediately downstream of the exit to the blowing pipe and during the expansion phase. Thus the point chosen for the spraying or injection of the isocyanate on of the fibres is one at which the fibres move at particularly high speeds. The static pressure in the digester, the refiner and in the blowing pipe also no longer exists, but has been transformed into dynamic pressure. As a result only very short contact times advantageously result between the isocyanate ejected from the nozzles and the fibres flying past at high speeds. It is also possible for the isocyanate to be sprayed on to the fibres at the point of their highest rate of flow.

The isocyanate is not sprayed on to the fibres either in the blowing pipe or after the drying process, as described in the prior art, but at the most appropriate point between these two stages. The first preferred point is directly downstream or the exit to the blowing pipe in processes where a separator is provided between the exit to the blowing pipe and the start of the drying process of relieve the drier of a portion of the water vapour of be removed. Another possibility is that of arranging the blowing pipe immediately upstream of the drier and applying the isocyanate to the fibres in the drier, preferably at the beginning of the drying process, so that the motion of the fibres in the drier can be utilised to allow further distribution of the isocyanate.

The pressure of the isocyanate is appropriately high when it is sprayed on to the fibres. Such pressures are understood to be up to about and in the order of 20 bars.

Figure 2:
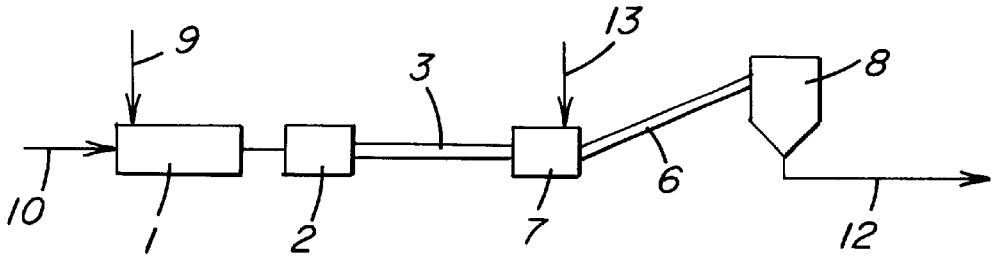
Figure 3:
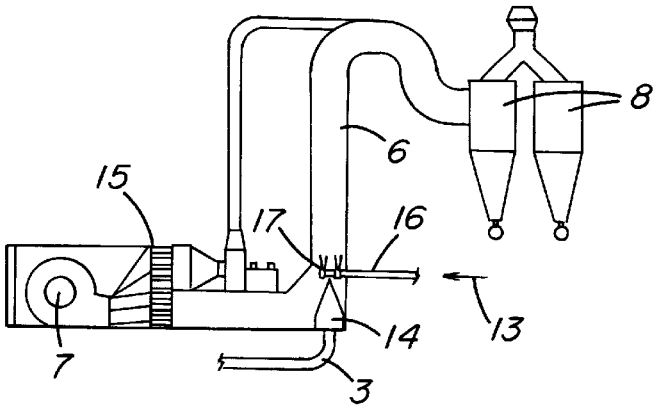
Figure 4:
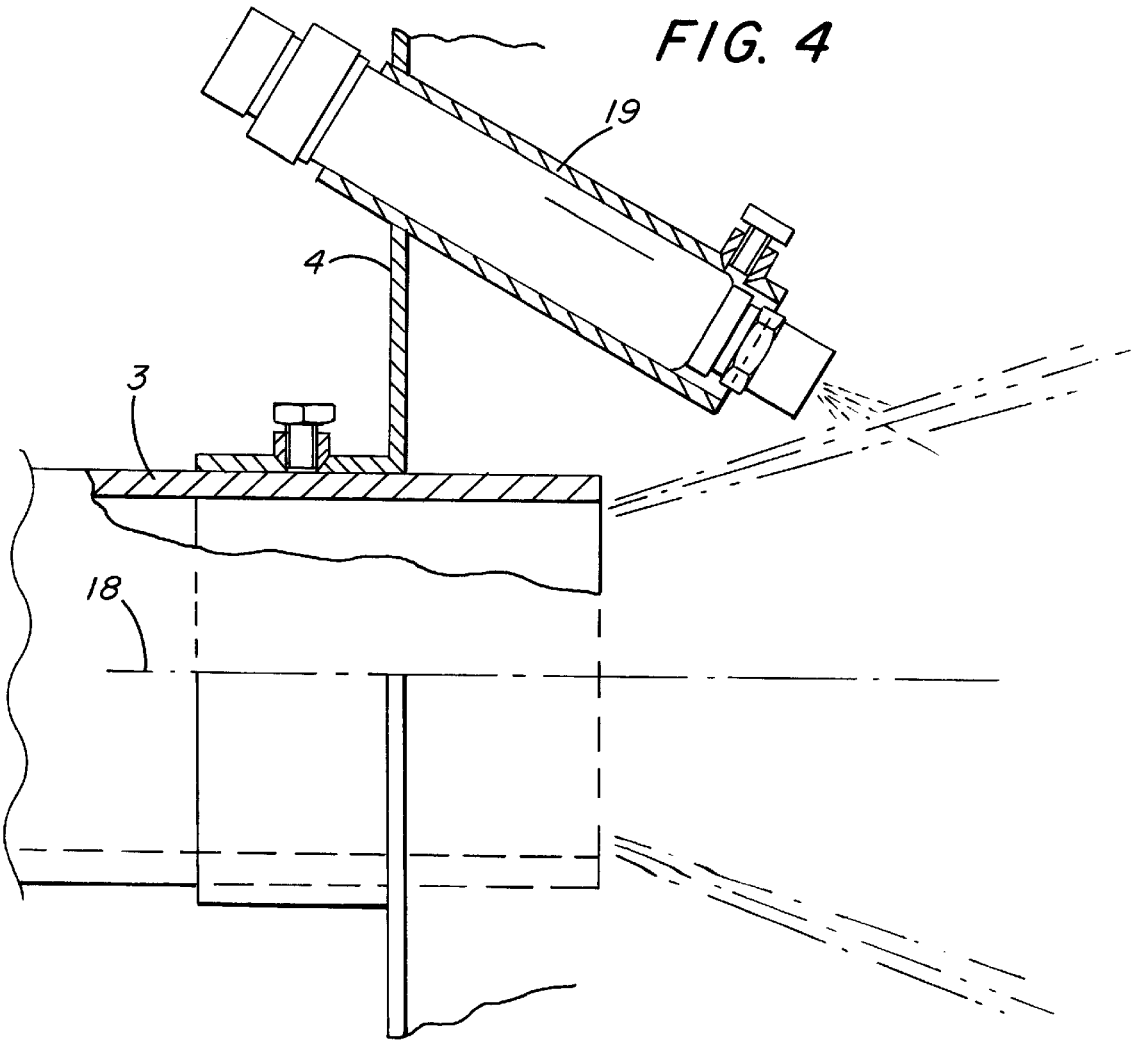

The invention is illustrated and described in more detail by means of the following preferred embodiments:

FIG. 1 depicts a schematic diagram of the most important parts of an apparatus for carrying out the process, FIG. 2 depicts the most important parts of another suitable apparatus for carrying out the process, FIG. 3 depicts a detailed section of the apparatus according to FIG. 2 and FIG. 4 depicts another detailed section illustrating the process of spraying the isocyanate on to the fibres.

FIG. 1 schematically depicts a digester 1 and a refiner 2. A blowing pipe 3 extends from the refiner 2 to a separator 4. A conveyor belt 5 is arranged downstream of the separator 4, a non-depicted cellular wheel sluice being arranged therebetween. A drier 6, to which a blower 7 and a separator 8 are connected, is also provided.

As shown by arrow 9, the coarse wood particles are fed into the pressurised digester 1 by means of an appropriate feeding device water vapour is simultaneously fed under pressure into the digester 1 as illustrated by arrow 10. In the digester 1 the wood particles are softened and then introduced into the refiner 2. The refiner 2 can be provided with grinding discs or similar means for reducing the wood particles to fine fibres. The digester 1, the refiner 2 and the blowing pipe 3 are operated under excess pressure. The blowing pipe 3 ends in the separator 4, expansion to normal pressure taking place at the end of the blowing pipe 3, since the pressure prevailing in the separator is ambient pressure. Water is evaporated as a result of the expansion. This water vapour is eliminated in the separator 4 and can be reintroduced into the digester 1 as shown by arrow 10. As a result of the evaporation of water the fibres are cooled and the isocyanate is sprayed on to the fibres in the separator 4 downstream of the exit of the blowing pipe 3, as shown by arrow 11, i.e. at a point where the fibres are at normal pressure and have a reduced temperature. The fibres are however still in motion at this point, so that isocyanate can be sprayed thereon in a finely distributed form. The fibres mixed with the isocyanate enter the drier 6 either via a conveyor belt 5 or directly from the separator 4, further water vapour being eliminated in the drier 6. Although the temperature of the fibres is increased as a result of the introduction of hot air, the throughput time of the fibres through the drier 6 is only comparatively short, so that the isocyanate is not significantly pre-cured. In the separator 8 the fibres and the drying air are separated from one another and, as shown by arrow 12, the fibres sized with isocyanate can be delivered for direct further processing into fibreboards, in particular to a mat-forming machine.

In the apparatus schematically depicted in FIG. 2 for carrying out the process the blowing pipe 3 is directly connected to the drier 6. One of the separators, 4, is therefore omitted. Although the quantity of the water vapour to be eliminated in the separator 8 is thereby increased, the throughput time of the fibres through the apparatus is reduced even further. The isocyanate binder is applied in the region of drier 6 as shown by arrow 13, i.e. also downstream of the exit of the blowing pipe 3 and upstream of the end of the drier 6. The application can take place by injection, preferably in the initial section of the drier 6.

FIG. 3 shows a somewhat more detailed diagram of a section of the apparatus according to FIG 2. In the figure the blowing pipe 3 ends with a distributor head 14 in the interior of a rising pipe in drier 6. The blower 7 is accommodated inside a suction housing which also has a radiator 15. A pipe 16 for the isocyanate ends with a ring nozzle arrangement 17, which is in a relative position to the distributor head 14 in the rising pipe of the drier 6, so that the isocyanate is applied to the fibres issuing from the distributor head 14 with a high degree of kinetic energy. The length of the rising pipe of the drier 6 is utilised for ensuring the uniform distribution of the isocyanate and the avoidance of size specks by means of the vortexing which occurs. In the separators 8 the water vapour and the hot air of the drier are eliminated. The fibres sized with isocyanate are discharged via cellular wheel sluices and delivered to the subsequent forming units for the fibreboards, which are not depicted in the figure.

FIG. 4 shows a section for the spraying of the isocyanate on of the fibres downstream of the exit to the blowing pipe 3. The exit of the blowing pipe 3 extends into the wall of a separator 4. This wall of separator 4 also accommodates several nozzle holders 19 which are distributed around the circumference of the axis 18 of the blowing pipe 3 and project into the interior of the separator 4. Nozzles 20 are arranged in the nozzle holders 19 in a displaceable and adjustable manner, with the aid of which the isocyanate is sprayed on to the expanding cone of fibres freely issuing from the exit of the blowing pipe 3.

Instead of the isocyanate being sprayed on to the fibres in a separator 4 arranged downstream of the exit of the blowing pipe 3 it can also be sprayed on to the fibres in the initial section of a drier 6, as illustrated in FIG. 3.

List of reference numerals:

1=digester
2=refiner
3=blowing pipe
4=separator
5=conveyor belt
6=drier
7=blower
8=separator
9=arrow
10=arrow
11=arrow
12=arrow
13=arrow
14=distributor head
15=radiator
16=pipe
17=ring nozzle arrangement
18=axis
19=nozzle holder
20=nozzle

What is claimed is:

1. A process for the production of fiberboards from coarse wood particles and isocyanate as binder comprising:

i) introducing the coarse wood particles and water vapor under pressure into a pressurized digester where the particles are softened, ii) introducing the softened particles into a pressurized refiner where the particles are reduced to fine fibers, iii) introducing the fibers into a blowing pipe, iv) spraying the isocyanate onto said fibers after they exit from said blowing pipe and before they are dried, and v) passing the so-sprayed fibers to a drier.

2. The process of claim 1, wherein the isocyanate is sprayed onto said fibers while said fibers are at normal pressure.

3. The process of claim 1, wherein the isocyanate is sprayed onto said fibers immediately downstream of the exit to said blowing pipe.

4. The process of claim 3, wherein the isocyanate is sprayed onto said fibers at the point of the maximum rate of flow of said fibers.

5. The process of claim 1, wherein the isocyanate is sprayed onto said fibers as they enter said drier.

* * * * *